United States Patent [19]

Zimmerly et al.

[11] Patent Number: 4,850,704

[45] Date of Patent: Jul. 25, 1989

[54] TWO STAGE BLENDER

[75] Inventors: Robert D. Zimmerly; Robert J. Riemer, both of Kenosha, Wis.

[73] Assignee: Ladish Co.

[21] Appl. No.: 161,300

[22] Filed: Feb. 25, 1988

Related U.S. Application Data

[63] Continuation-in-part of Ser. No. 901,366, Aug. 28, 1986, abandoned.

[51] Int. Cl.[4] ..... B01F 7/04

[52] U.S. Cl. ..... 366/263; 366/264; 366/290; 366/293

[58] Field of Search ..... 366/176, 263–265, 366/279, 290–295, 317; 415/199.1, 199.2

[56] References Cited

U.S. PATENT DOCUMENTS

| | | | |
|---|---|---|---|
| 1,109,133 | 9/1914 | Melchers | 415/199.1 |
| 1,976,955 | 10/1934 | MacLean | 366/264 |
| 2,882,149 | 4/1959 | Willems | 366/253 |
| 2,910,223 | 10/1959 | Schlumbohm | 415/199.1 |
| 3,400,915 | 9/1968 | Onishi et al. | 366/290 |
| 3,606,270 | 9/1971 | Zimmerly | 366/263 |
| 3,679,182 | 7/1972 | Clocker | 366/263 |
| 3,959,838 | 6/1976 | Hannah | 15/1.7 |
| 4,277,223 | 7/1981 | Nelson | 415/199.1 |
| 4,400,219 | 8/1983 | Vanderputten et al. | 366/293 |
| 4,729,663 | 3/1988 | Karg | 366/264 |

*Primary Examiner*—Harvey C. Hornsby
*Assistant Examiner*—Corinne M. Reinckens
*Attorney, Agent, or Firm*—Fuller, Puerner & Hohenfeldt

[57] ABSTRACT

A two stage blender is capable of handling high viscosity liquid-powder mixtures. The mixture discharged from the first stage is directed to the second stage, from which it is discharged at a relatively high discharge pressure. The second stage further enhances the natural vacuum created within the first stage, so that powder is fed at a constant ratio for a wide variety of liquid flows. Selected internal parts of the blender are designed to permit cleaning the blender in place.

12 Claims, 6 Drawing Sheets

2-17
10
15
20 RSI
VACUUM
30
25
20
15
10
5
0
20
40
60
80
100
120
140
160
FLOW (G. P. M.)

1-45
50 RSI
VACUUM
30
25
20
15
10
5
0
20
40
60
80
100
120
140
160
FLOW (G. P. M.)

230
238
232
236
234
210
212
214
216
218
225
242
240
171
239
194
194
47
223
189
190

TWO STAGE BLENDER

CROSS REFERENCE TO RELATED APPLICATION

This application is a continuation-in-part of application Ser. No. 901,366 filed Aug. 28, 1986.

BACKGROUND OF THE INVENTION

1. Field of the Invention

This invention pertains to mixing apparatus, and more particularly to apparatus for continuously blending powders with a liquid.

2. Description of the Prior Art

Exemplary apparatus for blending liquids and particulate solids is disclosed in U.S. Pat. No. 3,606,270. That blender has met with considerable commercial success.

However the blender of the U.S. Pat. No. 3,606,270 is somewhat limited in its ability to handle high viscosity liquid-powder end products. That is because, as the end product viscosity increases, the blender outlet pressure decreases and the vacuum created in the eye of the blender impeller becomes quite low. Consequently, the amount of powder drawn into the impeller decreases and yields a higher ratio of liquid to powder than is desired. To alleviate that problem, the screen that normally surrounds the impeller periphery may be removed, but then the mixing action produced by the liquid and powder flowing through the screen becomes unavailable. Accordingly, blender performance and product consistency occasionally become unacceptable at high end product viscosities.

Thus, a need exists for a blender capable of handling high viscosity liquid-powder end products and wherein there is not a significant drop in vacuum at the inlet as more powder is added so that the addition rate of powder remains constant for a wide range of applications from low to high viscosity mixing and blending and with high flow rates. With prior art single stage blenders the vacuum typically decreases below 20 to 25 inches of mercury and the powder addition rate goes down with increases in viscosity. This results in a decrease in the rate of addition of powder and a longer period of time to mix the powder. The longer mixing time and resulting churning action causes aeration of the mix and undesirable foam.

SUMMARY OF THE INVENTION

In accordance with the present invention, a liquid-solid particulate blender is provided that efficiently mixes and discharges high viscosity end products by maintaining the vacuum at the powder inlet relatively constant. This is accomplished by apparatus that includes a second stage mixing zone that assists drawing the liquid-powder mixture from the first stage and that increases the blender outlet pressure.

In the first stage mixing zone the liquid and powder are blended in a known fashion. Liquid is pumped tangentially around a diffuser tube and into the first stage mixing zone in the same direction as the rotation of a blender impeller. The liquid is introduced at the leading edge of the impeller, which has a central recess radially inwardly from the impeller vanes. The impeller accelerates the liquid radially outwardly, thereby creating a vacuum at the central recess. The natural suction created at the impeller recess pulls the powder from a storage hopper to the recess through the diffuser tube. Powder and liquid mixing occur as they are accelerated radially outwardly by the impeller. The mixture is forced through an annular screen surrounding the impeller periphery, thereby further mixing the ingredients.

The liquid and powder leaving the first stage mixing zone are discharged to the second stage mixing zone that is in series with the first stage. The mixture is directed downwardly and radially inwardly after leaving the first stage annular screen. Simple baffles create an internal passage through which the mixture from the first stage enters the central recess of a second stage impeller. The second stage impeller again accelerates the mixture radially outwardly and through a second stage annular screen. As a result of the operation of the second stage mixture zone, the vacuum produced at the first stage impeller recess is enhanced, and the flow of powder into the first stage mixing zone remains relatively constant, even with high viscosity end products. Moreover, the second stage increases the blender outlet pressure to provide increased flow notwithstanding high viscosity end products.

Comparative test results of the prior art single stage blender and the two stage blender of the invention have revealed unexpected results. As the viscosity of the mix got higher the vacuum at the inlet from the hopper got higher. This is not expected with a centrifugal type pumping system for typical pump back pressures but only with a positive pressure pump. The test curves of the two stage blender revealed a relatively constant vacuum for withdrawing powder from the hopper and into the blender with increases in viscosity. The advantageous performance of the blender of the invention is afforded by a first stage which has an impeller with more surface area than the impeller of the second stage. Also the clearance between the impeller edges and the housing are greater in the first stage. This results in good mixing or blending in the first stage and good pumping pressure characteristics in the second stage with the tighter fit of the impeller in the housing. This tighter fit of the impeller in the second stage enhances the vacuum in the first stage for withdrawing of powder from the hopper and also increases the output pressure of the second stage. The second stage provides a higher pressure differential through the first stage. The object of combining the second stage with the first stage in the design phase was to reduce the length of pipe required to connect a single stage blender to a second remote pump and also to eliminate piping and the second pump. This also eliminates a motor starter and wiring. The results of the addition of the second stage were not predictable. The close coupling of the first and second stage with a large flow area or pass through of almost 360° from the annular chamber of the first stage into an intermediate chamber prior to entering the second stage has eliminated significant pressure drops which would occur with two separate pumps interconnected by long lengths of standard small diameter piping.

Further in accordance with the present invention, the baffles between the first and second mixing zones are designed to permit cleaning in place the blender first stage mixing zone. For that purpose, a clearance is provided between the first stage impeller and the baffle member adjacent thereto. Accordingly, the blender may be flushed and cleaned without complete disassembly, thereby reducing lost production time.

Other objects and advantages of the invention will become apparent to those skilled in the art from reading the disclosure.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 2:
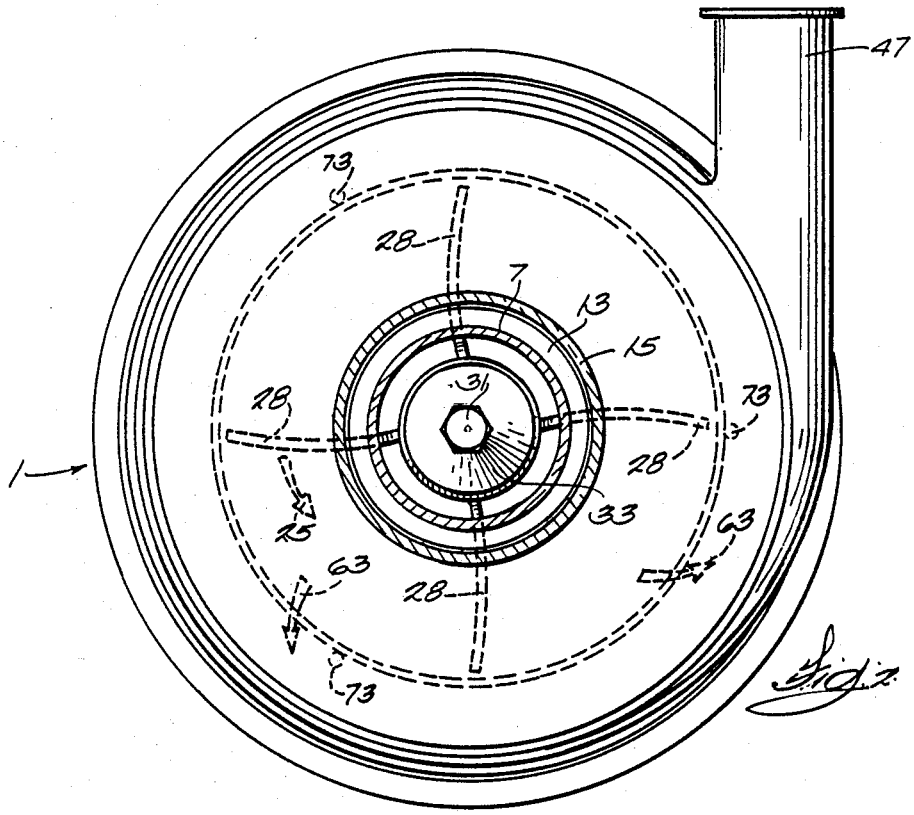
FIG. 2 is a cross-sectional view taken along lines 2—2 of FIG. 1.
Figure 1:
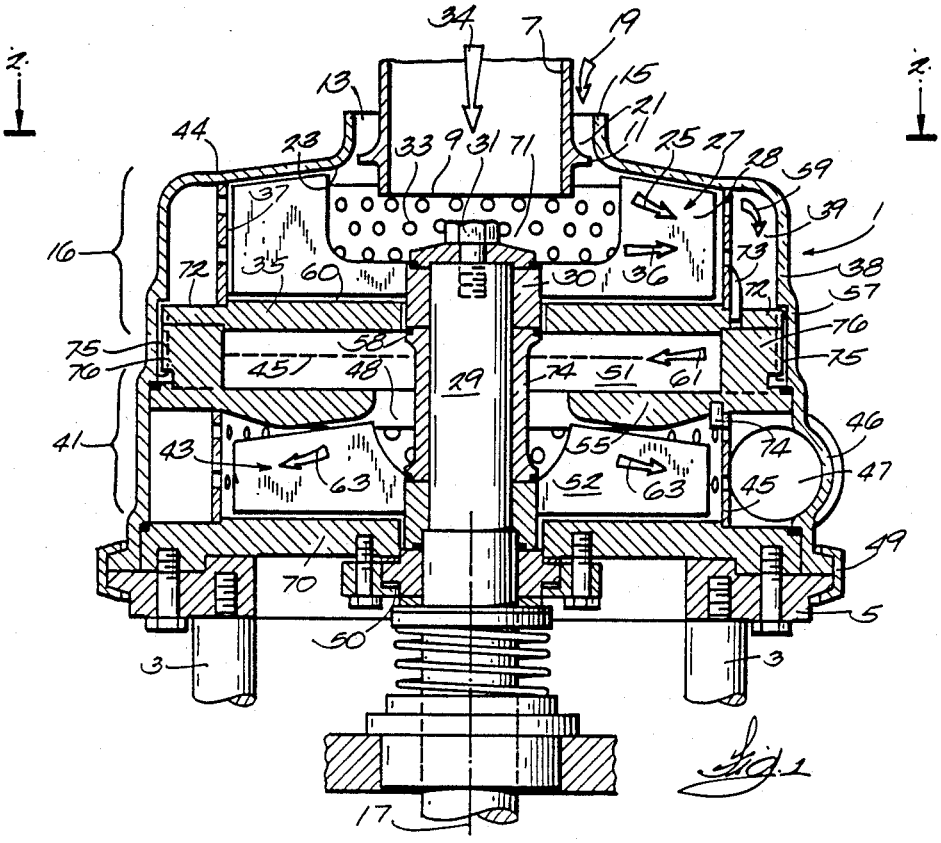
FIG. 1 is a partial longitudinal cross-sectional view of the blender of the present invention.

Referring to FIGS. 1 and 2, a two-stage blender 1 is illustrated that includes the present invention. The blender is particularly useful for mixing liquid and solid food and beverage ingredients into a high viscosity edible end product. However, it will be understood that the invention is not limited to sanitary applications.

The blender 1 is used in connection with an electric motor, drive system, and storage hopper that are not illustrated in FIGS. 1 and 2. The motor, drive, and hopper are described in U.S. Pat. No. 3,606,270, which is incorporated by reference herein. The blender may be supported on a stand, not shown, by posts 3 that are attached to a bottom ring 5.

Located above the blender 1 is the hopper for storing particulate solids, which may be in the form of powders. The powder enters the blender by means of diffuser tube 7. The lower end 9 of the diffuser tube 7 is provided with an annular flange 11. The upper surface of the flange 11 is shaped with a radius 21 that approximates the radius 23 of the inner surface of the blender casing inlet 15 adjacent the flange 11. The diffuser tube 7 is concentrically located within the blender casing inlet 15.

The blender 1 includes a first stage mixing zone 16 bounded by the casing 44. Although in the disclosed construction the casing 44 is one piece, an alternate construction could employ a two-piece casing split, for example, along line 45 as illustrated in the modified embodiment in FIGS. 4 and 5.

The components within the first stage mixing zone 16 comprises a first stage impeller 27, which, as best shown in FIG. 2, may have four vanes 28. The vanes 28 extend radially outwardly from a central hub 30 having a length less than the height of the vanes, thereby forming a central recess 33. As illustrated, the lower end 9 of the diffuser tube 7 extends into the recess 33. The impeller 27 is attached to a drive shaft 29 for rotation therewith by an electric motor and drive system. The first stage impeller 27 is secured to the end of the shaft 29 by a screw 31 through a washer 71. Surrounding the periphery of the impeller 27 is a first stage annular screen 37. The first stage screen 37 rests on an upper baffle member 35 that has four equally spaced tabs 72 on the outer circumference of the upper baffle member 35. A pin 73 is fixedly attached to the first stage annular screen 37 extending below the bottom of the first stage annular screen 37 and abutting against one of the four equally spaced tabs 72 of the circular plate 35 to prevent rotation of the first stage annular screen 37. The casing 44 bounding the first stage mixing zone 16 is fabricated with a wall 38 that is radially spaced outwardly from the screen 37 to create a first discharge volume 39.

In accordance with the present invention, the blender 1 further includes a second stage mixing zone 41. The second stage mixing zone 41 is bounded by the common casing 44 and includes a second impeller 43 secured for rotation to the shaft 29. The second stage impeller 43 is separated from the first stage impeller 27 by spacer 74 that fits concentrically around shaft 29. The second stage impeller 43 is generally similar to the first stage impeller 27, having a central recess 48 and several vanes 52 radiating therefrom. However, the second stage impeller vanes 52 extend radially inwardly farther than the vanes 28 of the first stage impeller 27, so that the second stage recess 48 is smaller than the first stage recess 33. The periphery of the impeller 43 is surrounded by a second stage annular screen 45. The second stage annular screen 45 rests on a circular plate 70 to which is fixedly attached the support ring 5. The shaft 29 extends through a sealing means 50 in the circular plate 70. Casing 44 has a wall portion 46 that is radially spaced outwardly from the screen 45 to create a second discharge outlet 47. The casing 44 and the support ring 5 may be releasably joined to each other by means of a quick-couple connector 49.

In the illustrated construction, a passage 51 is formed between the first and second mixing zones 16 and 41 by means of internal baffles. The baffles comprise an upper baffle member 35 that has four equally spaced tabs 72 on its outer circumference. The baffles further include a generally horizontal lower member 55 which provides four spacer supports 76 to provide an axial spacing from the upper baffle member 35 and is preferably concentric with the upper baffle member 35. A downwardly sloped wall portion 57 of the casing 44 completes the contours of the passage 51. The lower member 55 has provisions to receive a pin 74 that is fixedly attached to the upper portion of the second stage annular screen 45 to prevent rotation of the second stage annular screen. Slots 75 are formed in casing 44 to prevent the rotation of the lower member 55.

Further in accordance with the present invention, the first stage mixing zone 16 is constructed so that the components thereof may be cleaned in place. For that purpose, the impeller 27 and upper baffle member 35 are located with respect to each other such that a radial clearance 58 and an axial clearance 60 exist between the impeller 27 and upper baffle member 35. The clearances 58 and 60 are sized to permit only minimal amounts of the powder-liquid mixture to pass through the clearances, but to allow passage of sufficient flushing fluid to permit cleaning the components without disassembling them. As a result, the first stage mixing zone of the blender 1 of the present invention may be cleaned with only minimum loss of production time.

In operation, the blender 1 of the present invention mixes liquids and powders into end products having higher viscosities than can be handled by single stage blenders. Liquid is introduced into the blender first stage 16 through the hollow cylindrical space 13 that is located between the diffuser tube 7 and the blender casing inlet 15. The entering liquid has a roatational component of motion about the central axis 17 and a downward component of motion, as indicated by arrows 19. When the liquid strikes the radius 21 of the flange 11, it is deflected radially outwardly, as indicated by the arrow 25. The rotational motion of the incoming liquid is in the same direction as the rotation of the impeller 27.

The impeller 27 imparts a radially outward acceleration to the liquid. Simultaneously, the impeller creates a natural vacuum within the recess 33, thereby drawing particulate solids from the hopper through the diffuser tube 7 and into the recess 33, as indicated by arrow 34. The solids are then accelerated outwardly by the impeller vanes 28, arrow 36, and they are mixed with the liquid. The mixture is forced through the first stage screen 37, which further mixes the ingredients. As illustrated by arrows 59, the mixture discharged from the first stage mixing zone 16 is diverted downwardly by the casing wall 38 into the passage 51. The baffles composed of the members 35 and 55 and the casing wall 57 direct the mixture radially inwardly toward axis 17 and into the recess 48 of the second stage mixing zone impeller 43, as indicated by arrows 61. From the second mixing zone recess 48, the impeller 43 again accelerates the mixture radially outward. Finally, the mixture is forced through the second stage screen 45 and into the discharge outlet 47, arrow 63.

Figure 3:
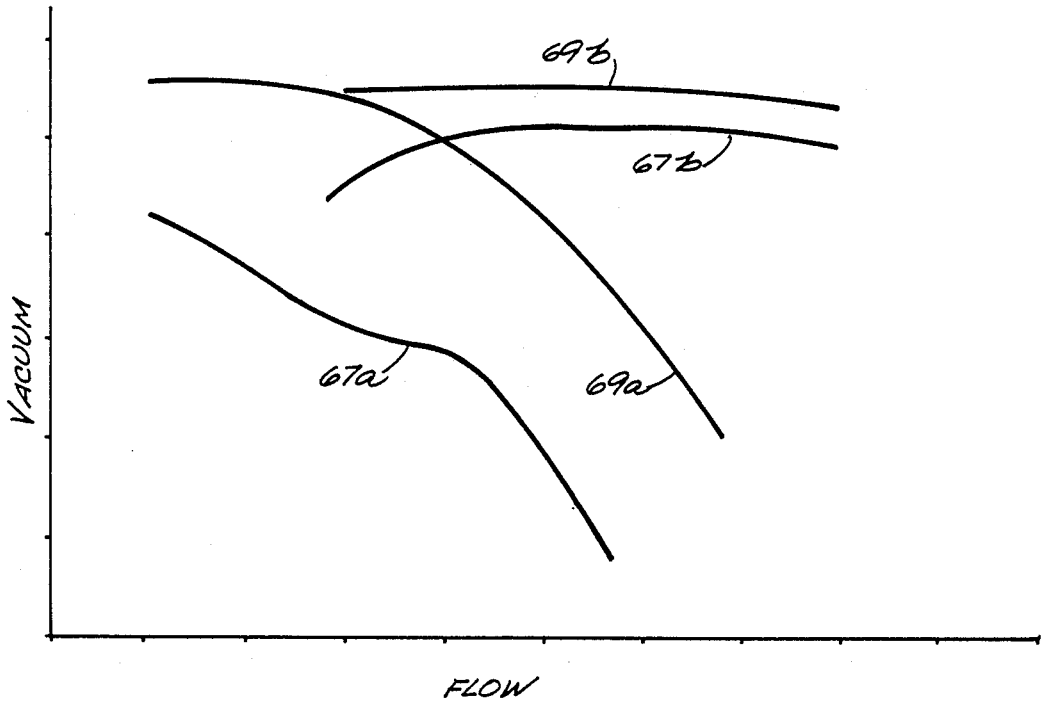
FIG. 3 is a set of performance curves for a prior blender and for the blender of the present invention.

The addition of the second stage 41 of the blender 1 of the present invention enhances the vacuum produced at the first stage recess 33, thereby drawing the particulate solids through the diffuser tube 7 in a uniform manner, even with high viscosity end products. Referring to FIG. 3, the improved performance of the two stage blender 1 is graphically illustrated. Curves **67*a* and 69*a* qualitatively depict, for two certain typical operating conditions, the changes in vacuum at the first stage recess 33 with change in product flow. The decrease in vacuum with increased product flow corresponds to a decreased powder-to-liquid ratio, i.e., with less vacuum, less powder is pulled from the hopper at a particular liquid flow. Consequently, the end product consistency and ingredient ratio may fall outside the formula specification. Curves 67*b* and 69*b* qualitatively depict the performance of the two stage blender 1 of the present invention under the same operating conditions as curves 67*a* and 69*a*, respectively. The volume at the first stage mixing recess 33 remains relatively constant with increased product flow, thus insuring proper ingredient ratios even at high end product viscosities. Further, the second stage 41 increases the discharge pressure at the discharge outlet 47**, thereby overcoming the problems associated with mixing high viscosity end products in a single stage blender.

Figure 4:
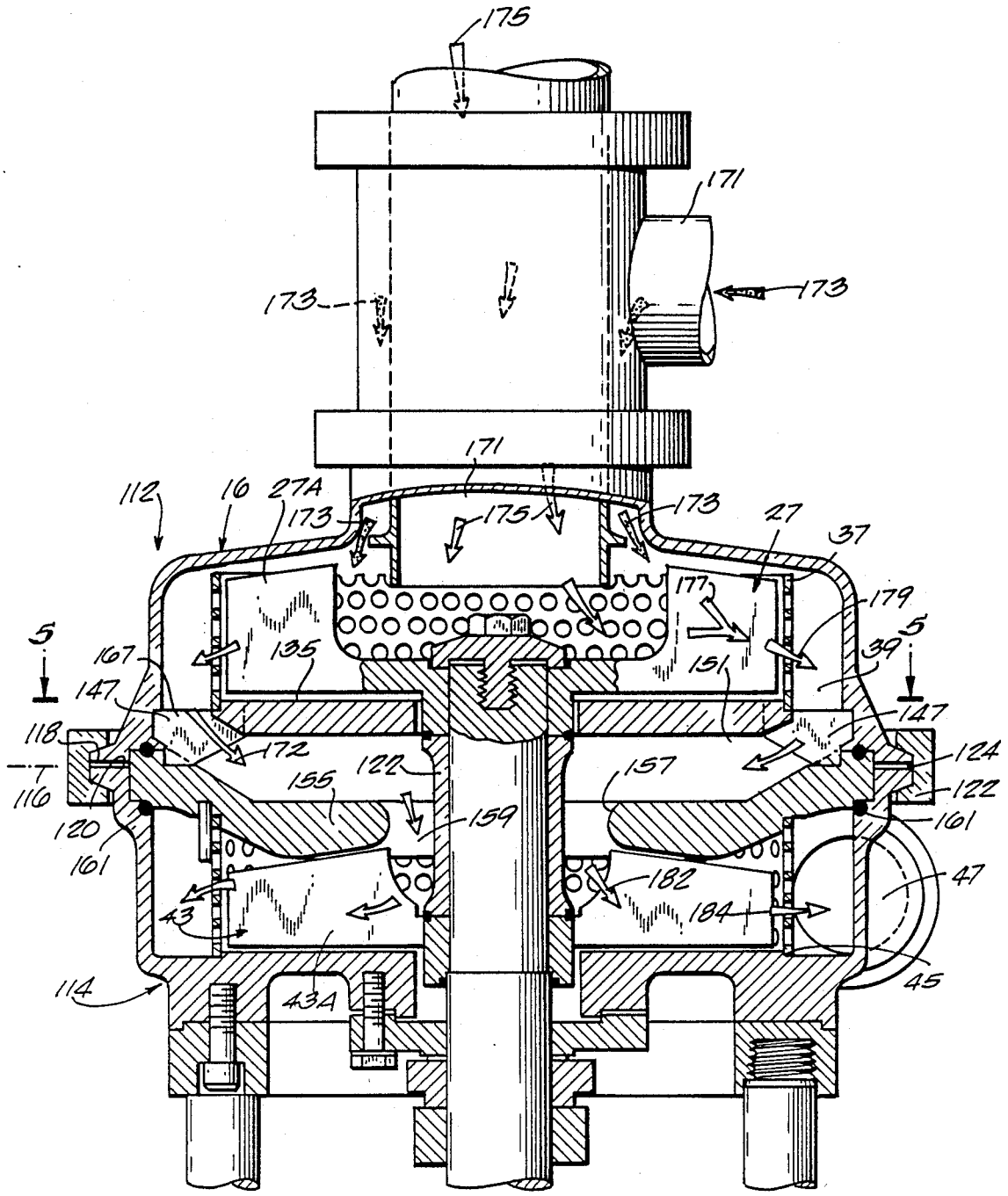
FIG. 4 is a sectional view similar to FIG. 1 of a modified embodiment of the invention.
Figure 5:
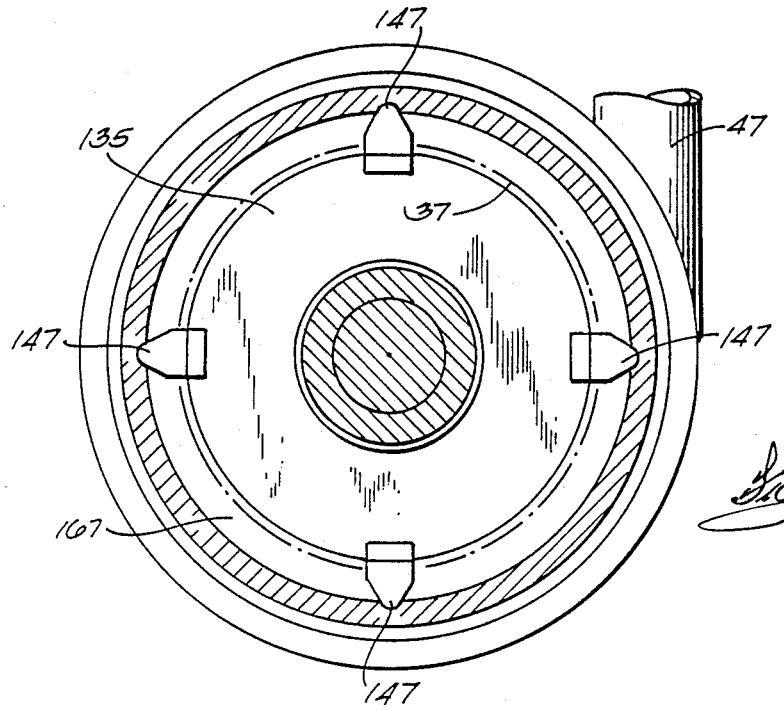
FIG. 5 is a sectional view taken along line 5—5 of FIG. 4.

FIGS. 4 and 5 show a modified embodiment of the blender in which the casing is formed from an upper casing section 112 and a lower casing section 114 which join at a split line 116. Annular flange 118 on the upper casing 112 abuts annular flange 120 on the lower casing 114. A conventional clamp 122 connects the housing sections together. The flanges are sealed by o-rings 124 and 161. An upper baffle member 135 similar to baffle 35 separates the first stage from the passage or intermediate chamber 151.

The baffle 135 is provided with four spaced apart protruding support lugs 147 which support the screen 37 and interrupt the annular or ring shaped gap or passage 167 which provides pass through of mix as shown by arrow 172 from the first stage 16 to the chamber 151. The intermediate chamber 151 is also defined in part by a baffle 155 which has a central rim 157 which provides an annular or ring shaped passage 159 for mix to go from the intermediate chamber 151 to the second stage. Arrows 173 represent the introduction of liquid in the first stage and arrows 175 represent the introduction of powder into the system. Arrow 177 shows the mixing of powder and liquid in the first stage and arrows 179 show the movement of the mix through the screen 37 to an annular chamber 39 enroute to the intermediate chamber 151. Arrows 182 show mix movement into the second stage between the impeller blades. Arrows 184 represent flow from the second stage through annular screen 45 into the chamber which communicates with the outlet 47. To facilitate mixing and blending of the powder with the liquid the impeller 27 has a significantly larger surface area of the blender blades 27A than the blades 43A of the second impeller 43. In addition the clearance between the impeller blades 27A and the adjacent walls of housing section 112 and the clearance with baffle 135 are significantly larger than the corresponding clearances of impeller blades 43 and the housing section 114 and the baffle 155. The large clearance provides more turbulence to enhance mixing. The small clearance of the second stage provides better pumping action in the second stage to increase the pressure differential across the first stage between inlet and outlet. This increase in pressure differential over the prior art single stage blender provides the significantly improved operating results subsequently described. The blender tested had an impeller clearance of one-eight of an inch in the first stage at the top of impeller 27A and an impeller clearance of one-sixteenth of an inch at the bottom of impeller 27A. In the second stage the impeller of 43A had a clearance at top and bottom of one sixty-fourth of an inch and provided good results.

The blender with the split housing is more economical to manufacture and alignment of the parts is not as difficult as compared to the FIG. 1 embodiment.

Figure 6:
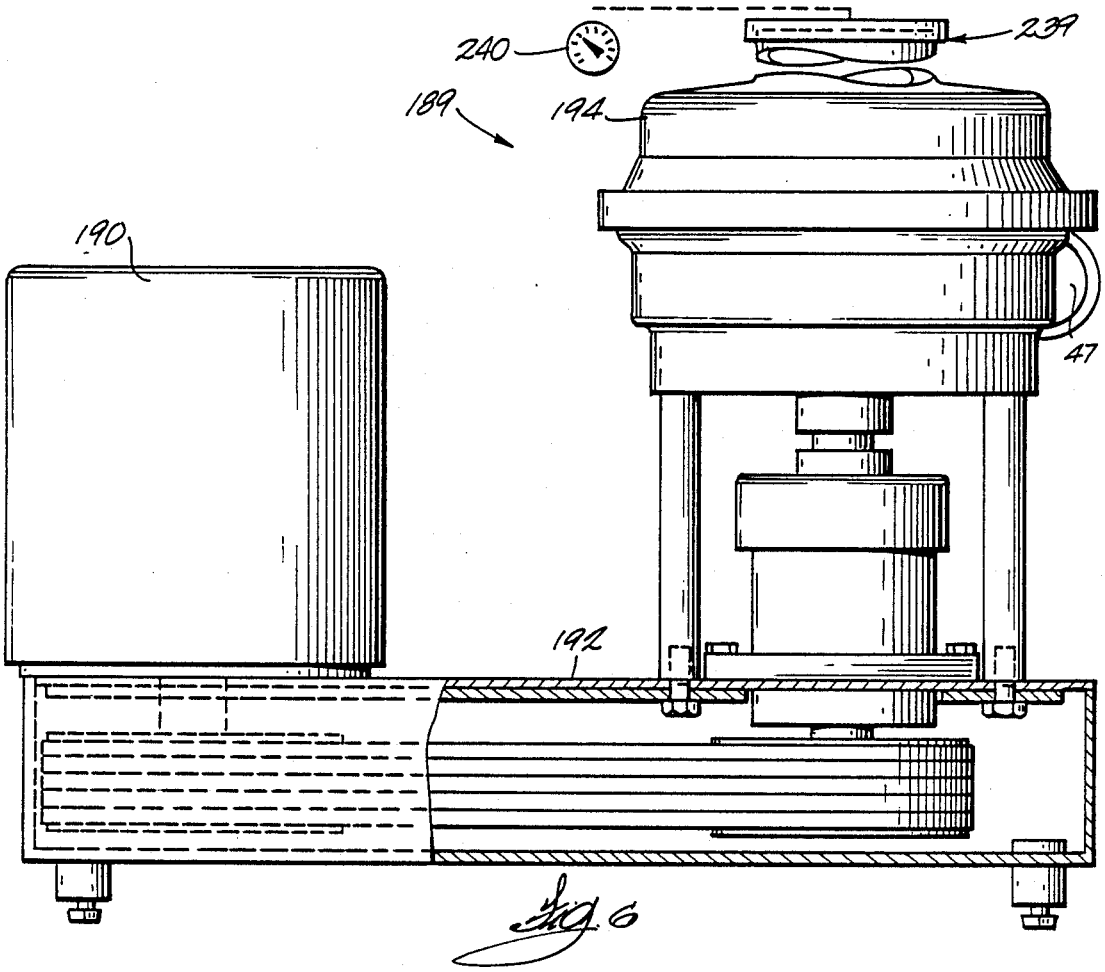
FIG. 6 is a side elevation view of a blender and motor in accordance with the invention.

FIG. 6 illustrates an assembly 189 of a motor 190 on a chassis 192 with a blender 194 in accordance with the invention. A cap 239 is shown with a vacuum gauge in place of the hopper 242 illustrated in FIG. 7.

Figure 7:
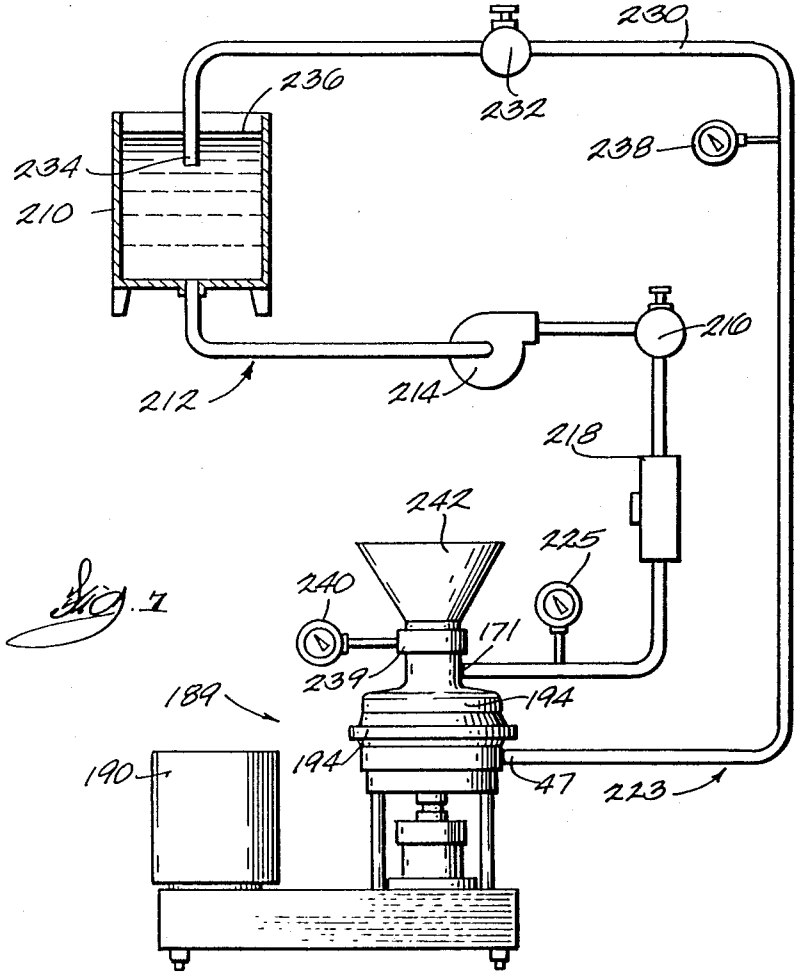
FIG. 7 is a diagrammatic view of the blender of the invention in a test set up.

FIG. 7 shows the motor blender assembly 189 illustrated in FIG. 6 incorporated into a test set up with a liquid-powder mix reservoir 210 connected by a plumbing circuit 212 to the blender liquid inlet 171 (see FIG. 4). A pump 214, a valve 216, and flow meter 218 are in the circuit 212 from the reservoir 210. A pressure gauge 225 is also provided. The outlet 47 of the blender is connected to a return circuit 223 which includes a gate valve 232 and a conduit outlet 234 beneath the level 236 in the reservoir. A second pressure gauge 238 is also employed.

The same test setup described above for use with the two stage blender of the invention was also employed with the single stage prior art blender of the type illustrated in U.S. Pat. No. 3,606,220, the disclosure of which is incorporated herein by reference for comparative results as hereinafter described.

During the tests the inlet to the hopper was capped during the test by the cap 239 and filled with a vacuum gauge 240 (FIG. 4).

The vacuum or suction applied to the hopper 242 was measured with gauge 240. Tests were run with varying viscosities to determine the characteristics of the two stage blender as compared to the single stage prior art blender. The tests were all run at 110° F. with different sugar, water mixes which were recycled through the blender by pump 214. The following tests are representative of the tests made.

ONE STAGE PRIOR ART

Figure 8:
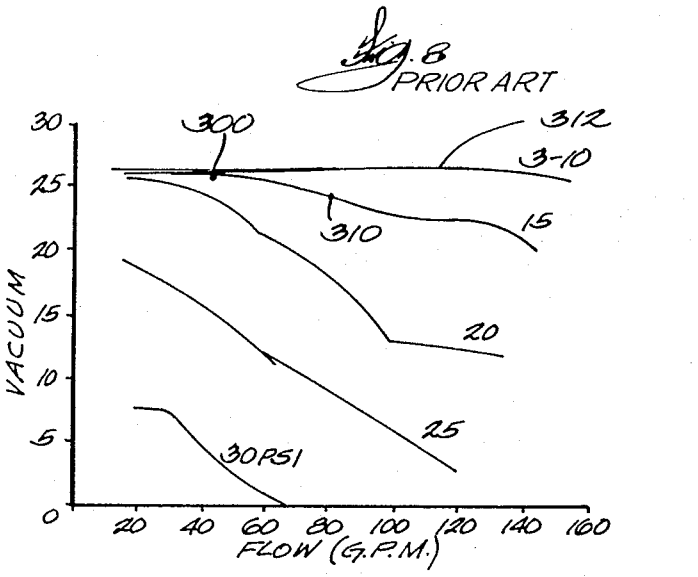
Fig. 8 PRIOR ART
FIG. 8 is a set of performance curves of a prior art blender.
Figure 9:
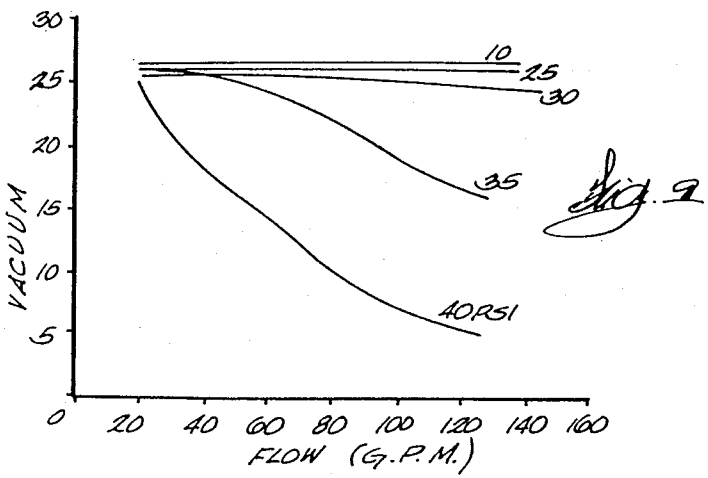
FIG. 9 is a set of performance curves for the two stage blender of the invention for a test batch similar to FIG. 8.

| Blender Model F3218MD | Two Stage Blender of Invention |
|---|---|
| FIG. 8 | FIG. 9 |
| Batch #1 | Batch #1 |
| S.G. (specific gravity) 1.0475 | S.G. 1.042 |
| 10.6 CPS (Centipoise) Viscosity | 10.5 CPS Viscosity |
| BRIX (% of solids in liquid) 11.8 | BRIX 10.2 |
| FIG. 10 | FIG. 11 |
| Batch #4 | Batch #4 |
| S.G. 1.1757 | S.G. 1.1702 |
| 21.5 CPS | 17.7 CPS Viscosity |
| BRIX 39.5 | BRIX 37 |
| FIG. 12 | FIG. 13 |
| Batch #8 | Batch #8 |
| S.G. 1.3374 | S.G. 1.342 |
| 71.2 CPS | 94.4 CPS |
| BRIX 68 | BRIX. 68.7 |

The X axis of the curves, FIG. 8–13, is the flow rate through the system measured by the flow meter 218. The Y axis contains the vacuum readings, with gauge 240 at the hopper inlet which shows the suction applied to the powder to withdraw powder from the hopper and introduce the powder into the blender powder inlet 171.

Each figure represents a series of tests with the similar batch of mix. The different curves in FIG. 8 (prior art) were performed by setting the flow rate on flow meter 218 at for example 40 gallons per minute and adjusting the back pressure with valve 232 to PSI of 15. The inches of mercury would then be read on gauge 240 of for example 26 inches of mercury and a point plotted, such as point 300. The valve 216 would then be opened to provide a flow rate of, for instance 80 G.P.M., and the back pressure adjusted to maintain a constant 15 PSI back pressure with valve 232 and a reading would be taken on gauge 240 of 24 and a point 310 plotted (FIG. 8).

In FIG. 8 the other curves show vacuum readings where the flow rate was increased and the back pressure maintained at 20, 25 and 30 PSI. The upper lines 312 represent a cluster of readings with 3 to 10 PSI. The curves in FIG. 8 show a dramatic decrease in inlet suction and powder addition as the back pressure is increased.

FIG. 9 (invention) shows curves with various back pressures including a cluster of generally horizontal lines made up by back pressure curves of 10, 25 and 30 and 40 PSI. The 30 PSI curve in FIG. 8 (prior art) shows almost no vacuum or suction at a flow rate of 60 G.P.M. and the two stage blender of the invention (FIG. 9) shows almost no drop in suction with 30 PSI up through a G.P.M. of 140.

Figure 10:
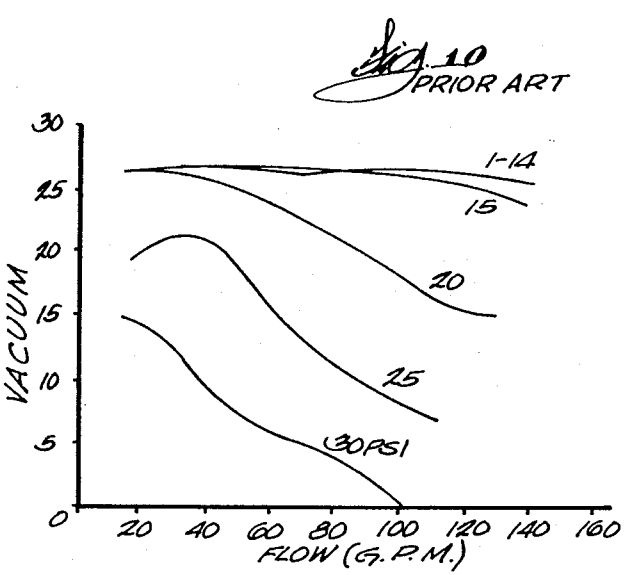
Fig. 10 PRIOR ART
FIG. 10 is a set of performance curves for a prior art blender.

FIG. 10 (prior art) shows curves with a batch having increased viscosity and shows improved suction or vacuum.

Figure 11:
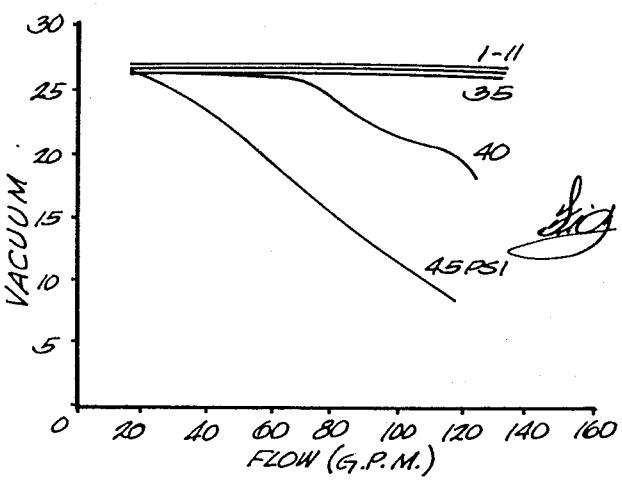
FIG. 11 is a set of performance curves for a two stage blender for a test batch similar to FIG. 10.

FIG. 11 (invention) shows a dramatic improvement at 35 PSI which shows almost no drop in suction at 120 G.P.M. as compared with FIG. 9 and significantly better suction than the single stage pump in FIG. 10. FIG. 10 shows there was no suction at 120 G.P.M. for 30 PSI. FIG. 11 shows that the increase in viscosity causes the operating characteristics to be linear or at a flat curve with no drop in suction as flow rate increases below 35 PSI.

Figure 12:
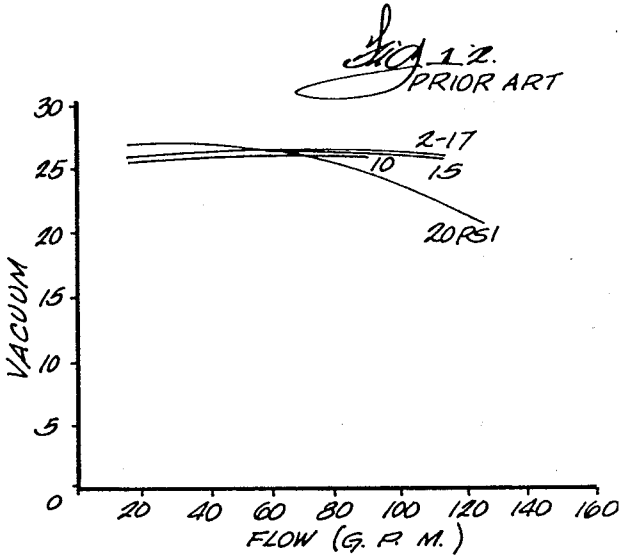
Fig. 12. PRIOR ART
FIG. 12 is a set of performance curves for a prior art blender.

FIG. 12 (prior art) shows that the increase in viscosity improves suction with the single stage pump.

Figure 13:
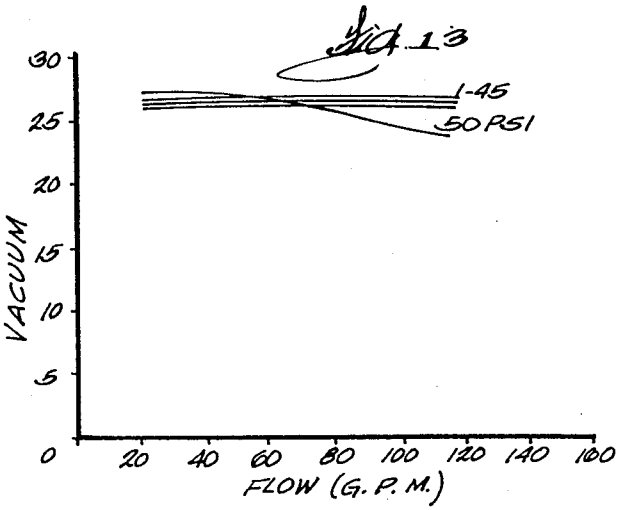
FIG. 13 is a set of performance curves for a two stage blender with a test batch similar to FIG. 12.

FIG. 13 (invention) shows that even at high PSI the suction or vacuum is flat with a slight drop at high flow rates at 50 PSI back pressure.

The foregoing results were not heretofore achieved in single stage blenders. Nor was the uniform suction or vacuum at the inlet to the first stage of a blender predictable or expected. These curves show that the two stages blender can operate at high back pressures such as would be caused by pumping the mix through a long section of pipe or pumping upward to an upper storage tank. This can eliminate the need for a pump downstream from the blender in many applications. With many prior art single stage blenders the powder addition rate drops with the increase in viscosity. This causes problems with automatic processes because monitoring of the hopper and powder addition rate is required to avoid churning and aeration. The constant or flat suction curve of the two stage blender avoids that problem.

The performance curves described above for the two stage blender also minimize time involved by the manufacturer in sizing of pumps for particular applications because a pump of a certain size will handle a wide range of requirements.

Thus, it is apparent that there has been provided, in accordance with the inventionn, a two stage blender that fully satisfies the aims and advantages set forth above. While the specification has been described in conjunction with specific embodiments thereof, it is evident that many alternatives, modifications, and variations will be apparent to those skilled in the art in light of the foregoing description. Accordingly, it is intended to embrace all such alternatives, modifications, and variations, as fall within the spirit and broad scope of the appended claims.

We claim:

1. A two stage blender for mixing liquid and powders into high viscosity end products comprising:

a. means for introducing the liquid and powders into the blender;

b. a first impeller mounted for rotation around a central axis and having a central recess of a first size for receiving the liquid and powder, the impeller imparting a radially outward acceleration to the powder and liquid to thereby mix them;

c. a casing surrounding the first impeller and defining a uniform annular passage to receive the mixed liquid and powder, the casing being formed with a wall shaped to direct the mixture axially and radially inwardly toward the central axis;

d. a pair of axially spaced baffle members concentric with the central axis for guiding the mixture from the casing annular passage inwardly toward the central axis and axially along the central axis;

e. a second impeller mounted for rotation about the central axis in unison with the first impeller, the second impeller having a central recess of a second size less than the size of the recess of the first impeller for receiving the mixture from the baffle members and for imparting a second outward acceleration to the mixture; and f. discharge means in the casing uniformly surrounding the second impeller for receiving the mixture from the second impeller, so that the mixture is discharged from the blender at a high pressure notwithstanding high end product viscosity.

2. The blender of claim 1 wherein the baffle members comprise an upper baffle member fabricated with predetermined radial and axial clearances relative to the first impeller to permit passing a flushing fluid through the clearances to enable cleaning the blender in place.

3. A blender for mixing solid particulates and liquid comprising:

casing means having a side wall and a generally cylindrical interior disposed about an axis and nominally upper and lower end walls, first stage blender means including first baffle means spaced from said upper and lower end walls, respectively, inside of said casing means for defining first and second axially spaced apart generally circular coaxial spaces in conjunction with said upper and lower end walls, respectively, said first circular space having first central inlet means for said particulates and for said liquid, said first stage blender means including an impeller in said first space for being driven rotationally about an axis which is generally perpendicular to said baffle means, said impeller having generally radially extending imperforate vanes between which, in the region of the axis of the vanes, said particulates and liquid are drawn from said inlets such that when the mixture is centrifuged radially from said vanes at one volumetric rate a partial vacuum is developed at said inlet means for particulates, said vanes having ends terminating in spaced relation in respect to said casing wall so as to define a first passageway about the impeller for receiving the mixture, the vanes having a height in the axial direction which results in first clearance between said vanes and said upper end wall and baffle means defining said space so as to contribute to developing said vacuum, a second stage pumping means including an impeller in said second space coaxial with said first stage impeller and driven rotationally jointly therewith, said impeller having generally radially extending imperforate vanes terminating in spaced relation with respect to said casing wall so as to define a space around said impeller including outlet means for outflow of the mixture, said second stage including second baffle means which define said second circular space having a second central inlet in communication with said first passageway for said mixture to be drawn into the spaces between said vanes of the second stage impeller said second inlet having a smaller cross sectional area and said vanes of said second impeller having a second clearance with respect to the second baffle means less than said first clearance in said first stage and centrifugally pumped radially outwardly to said surrounding space at a volumetric rate sufficient for keeping the centrifuged volumetric output rate from the first impeller stage substantially constant and, hence, keeping said vacuum at said particulate inlet means substantially within a narrow range approximately independent of the viscosity of the mixture passing through said second stage, and wherein the total pumping effect of the vanes of the second stage impeller is greater than the total pumping effect of the blades of the first stage impeller to impart high pressure to said mixture and to provide for said second stage impeller maintaining the flow rate of the mixture to said output means sufficiently high to keep the mixture flowing away from said inlet means at a sufficiently high rate to induce a substantially constant vacuum at said inlet means regardless of the viscosity of said mixture.

4. The blender according to claim 3 including an annular screen surrounding each of said impellers, said screens having an axial height at least as great as the axial height of the vanes of the impeller.

5. The blender according to claim 3 wherein the vanes of said first stage impeller are shaped to define a circular central recess aligned with and concentric to said inlets for the particulate solids and for the liquid to be admitted between said vanes and the vanes of the second stage impellers are shaped to define a circular central recess aligned with and concentric to said opening in said baffle means for the mixture discharged from said first stage impeller to be admitted between the vanes of said second stage impeller.

the recess in said second stage impeller being smaller than the recess in the first stage impeller.

6. The blender according to anyone of claim 1, 3, 4 or 5 wherein said casing is split and the split line between said casings is in between said first and second impellers and a clamping ring encircles the split line to hold the casings together.

7. The blender according to any one of claims 3, 4 or 5 wherein for back pressures on said outlet means in the range of about 10 to about 30 psi, said vacuum at said inlet means for particulate solids is maintained in a range of about 27 to about 23 inches of mercury, respectively, over a range of mixture flow rates through the blender of about 20 to 140 gallons per minute when the viscosity of the mixture is about 10 centipoises.

8. The blender according to any one of claims 3, 4 or 5 wherein for back pressures on said outlet means in the range of about 30 to about 35 psi, said vacuum at said inlet means for particulate solids is maintained in a range of about 24 to about 8 inches of mercury, respectively, over a range of mixture flow rates through the blender of about 20 to 120 gallons per minute when the viscosity of the mixture is about 10 centipoises.

9. The blender according to any one of claims 3, 4 or 5 wherein for back pressure on said outlet means in the range of about 1 to about 35 psi, said vacuum at said inlet means for particulate solids is maintained within a range of about 28 to about 25 inches of mercury, respectively, over a range of mixture flow rates through the blender of about 20 to 140 gallons per minute when the viscosity of the mixture is about 18 centipoises.

10. The blender according to any one of claims 3, 1 or 5 wherein for back pressure on said outlet means in the range of about 35 to 40 psi, said vacuum on said inlet means for particulate solids is maintained in the range of about 28 to about 23 inches of mercury, respectively, over a range of mixture flow rates through the blender of about 20 to about 70 gallons per minute when the viscosity of the mixture is about 18 centipoises.

11. The blender according to any one of claims 3, 4 or 5 wherein for back pressures on said outlet means in the range of about 1 to about 45 psi, said vacuum on said inlet means for particulate solids is maintained in the range of about 28 to about 24 inches of mercury, respectively, over a range of mixture flow rates through the blender of about 20 to about 120 gallons per minute when the viscosity of the mixture is about 95 centipoises.

12. The blender according to any one of claim 3, 4 or 5 wherein for back pressure on said outlet means of about 1 to about 50 psi, said vacuum on said inlet means is maintained in the range of about 28 to 22 inches of mercury, respectively, over a range of mixture flow rates through said blender of about 20 to about 120 gallons per minute when the viscosity of the mixture is about 95 centipoises.

* * * * *

UNITED STATES PATENT AND TRADEMARK OFFICE

CERTIFICATE OF CORRECTION

PATENT NO. : 4,850,704

DATED : Jul. 25, 1989

INVENTOR(S) : Zimmerly et al.

It is certified that error appears in the above—identified patent and that said Letters Patent is hereby corrected as shown below:

Column 10, Line 37:
delete the period (.) after "impeller" and insert a comma --- , ---

Column 11, Line 1:
Change the claim dependency to read:
--- 3, 4 or 5 ---

Column 11, Line 2:
Change "pressure" to --- pressures ---

Signed and Sealed this

Ninth Day of October, 1990

*Attest:*

HARRY F. MANBECK, JR.

*Attesting Officer*

*Commissioner of Patents and Trademarks*